US005129616A

United States Patent [19]

Carson

[11] Patent Number: 5,129,616

[45] Date of Patent: Jul. 14, 1992

[54] BOOK SUPPORT FOR SUPINE OR SEATED READERS

[76] Inventor: K. Lynden Carson, 6538 S. McAllister, Tempe, Ariz. 85283

[21] Appl. No.: 734,953

[22] Filed: Jul. 24, 1991

[51] Int. Cl.[5] ..... A47B 23/00

[52] U.S. Cl. ..... 248/457; 248/444.1; 248/445; 248/446; 248/453; 248/464

[58] Field of Search ..... 248/457, 445, 454, 455, 248/462–465, 446, 441.1, 148, 460, 444.1, 453, 464

[56] References Cited

U.S. PATENT DOCUMENTS

| | | | |
|---|---|---|---|
| 1,899,404 | 2/1933 | White | 248/457 X |
| 4,116,413 | 9/1978 | Andersen | 248/460 X |
| 4,119,289 | 10/1978 | Kanocz | 248/460 X |
| 4,313,589 | 2/1982 | Vega | 248/445 X |

FOREIGN PATENT DOCUMENTS

| | | | |
|---|---|---|---|
| 568264 | 1/1933 | Fed. Rep. of Germany | 248/148 |
| 648047 | 12/1990 | United Kingdom | 248/460 |

*Primary Examiner*—Alvin C. Chin-Shue

[57] ABSTRACT

A highly adjustable and simple to use book holder for supine or seated readers is provided by pairs of legs joined near their tops by slotted brackets, which pairs of legs define vertical planes straddling the reader. The slotted brackets allow the relative positions of the upper ends of the support legs to be adjusted. A book tray defining a transverse plane extends between the vertical planes formed by the leg pairs. Its location changes as the leg coupling brackets are adjusted. The tray rotates around an axis extending through holes near the upper ends of one or the other of the legs making up each pair. The variable position of the upper ends of the legs due to the slotted brackets, the rotatable tray, and the variable angle between the legs of each pair permit the position and orientation of the book relative to the viewer to be adjusted at will. A transverse auxiliary support brace is optionally provided between the outward legs of each pair to support the book holder on the thighs of a seated person.

12 Claims, 5 Drawing Sheets

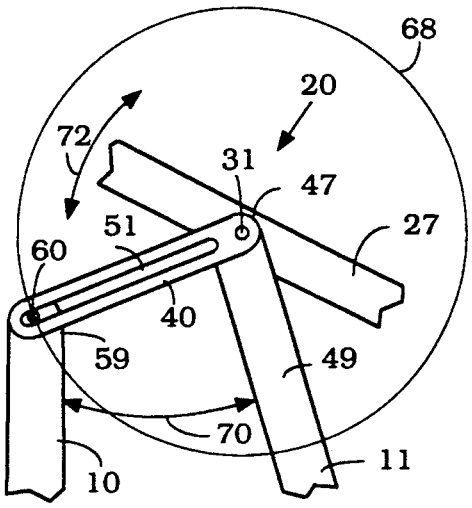
FIG. 5C
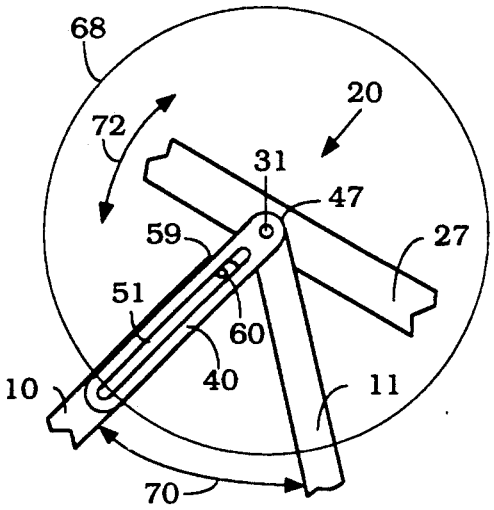
FIG. 5A
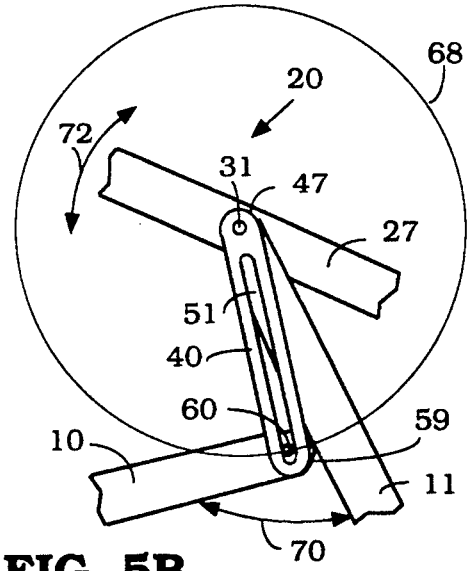
FIG. 5B
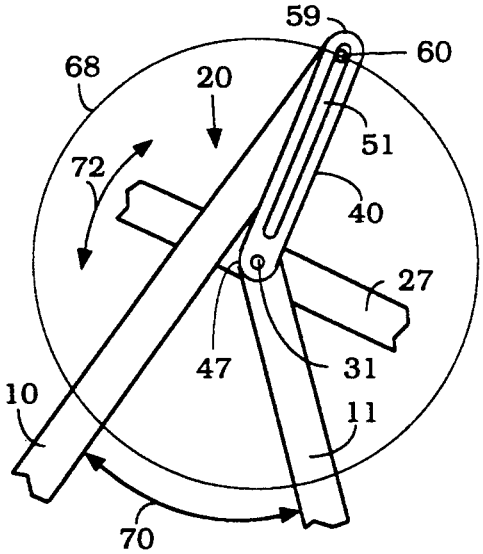
FIG. 5D
FIG. 8A
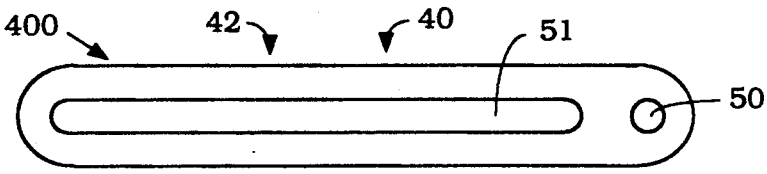
FIG. 8B
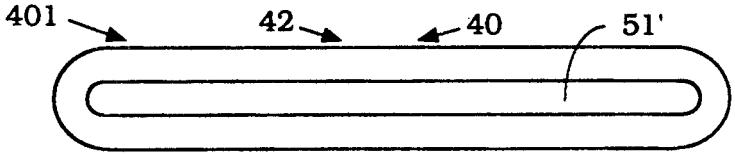

BOOK SUPPORT FOR SUPINE OR SEATED READERS

FIELD OF THE INVENTION

This invention relates to a support for printed matter and, more particularly, a light-weight, articulated, folding support adapted for use by seated or suspine readers to support a book or other printed matter in a position for convenient reading.

BACKGROUND OF THE INVENTION

As used herein, the word "book", whether or singular or plural, is intended to refer to reading matter in any form, as for example but not limited to, books, magazines, papers, brochures, pictures, photos and illustrations.

Many book supports have been designed and constructed heretofore for use while reading in bed or the like. For example, Motono describes a book holder in U.S. Pat. No. 1,609,180 having a tray containing various levers and rods for retaining the book in an open position and supported from a yoke attached to a floor or bed stand positioned to the side of the reader, Culbertson describes in U.S. Pat. No. 1,671,123 an adjustable reading or writing stand having a tiltable table for holding a book or writing paper and supported by a wire stand of fixed height that straddles the user's body, and Aibel describes in U.S. Pat. No. 2,741,869 a reading stand having a book support set at a fixed angle and supported by a pair of tubular inverted "U" shaped legs which straddle the reader's body.

Further, Anderson describes in U.S. Pat. No. 2,828,577 a book holder having a book support frame tiltable to three different angles and suspended from the apex of inverted "V" shaped legs of fixed length and adjustable angle, Lykes describes in U.S. Pat. No. 2,908,465 a holder for a bed reader which has a tiltable flat platen for retaining the book at the end of an arm supported by "L" shaped legs straddling the reader's body, and Reed describes in U.S. Pat. No. 3,664,629 an adjustable stand containing a tiltable tray held on a transverse rod supported at its ends by inverted "V" shaped legs of substantially fixed angle but adjustable length.

Still further, Adams describes in U.S. Pat. No. 3,740,015 a book supporting device having a transparent book support tray of substantially fixed angle held by inverted, approximately "V" shaped legs of adjustable length, Weir describes in U.S. Pat. No. 3,894,709 a reading table having a book support tray much like that of a music stand and tiltably attached to an rotatable arm supported by a cross-member attached to the upper ends of "L" shaped legs that straddle the reader's body, and Vega describes in U.S. Pat. No. 4,313,589 a reading desk having a fixed angle tray supported along each side edge by tubular "L" shaped support members providing knee-space therebetween.

These and other prior art book supports for supine or seated readers suffer from a number of disadvantages well known in the art. For example, most have been designed so that the reading matter is at an imperfect angle and/or distance with respect to the viewer or are unduly complicated in construction or use. Accordingly, there is an ongoing need for a book support for supine and/or seated readers that is simple in construction, highly adjustable to provide the desired viewing distance and angle, easy to use, and compact to store.

SUMMARY OF THE INVENTION

The present invention provides, in general form, a holder for material being viewed or read, comprising, a first pair of legs defining a first vertical plane and a second pair of legs defining a second vertical plane, first slotted bracket means extending between upper ends of the first pair of legs and second slotted bracket means extending between upper ends of the second pair of legs, for adjustably fixing the upper ends in predetermined relationship as to spacing and orientation, and for determining an angle between the legs of each pair, and transverse connection means substantially defining a plane transverse to the vertical planes and extending therebetween and adapted to rotate about a line extending between the vertical planes, for coupling the leg pairs together and supporting the material at an angle selected by the user.

It is desirable that the transverse connection means comprise a substantially rectangular frame having attachment points along opposed sides rotatably coupled to one leg of each pair. It is further desirable that one leg from each pair has a transverse brace member coupled therebetween for supporting the weight of the holder when used by a seated reader.

In a preferred embodiment, there is also desirably a fixed transverse brace coupling one leg from each pair to a leg of the other pair. Further, it is desirable that there be two slotted brackets lying along opposed flat faces of the each leg pair.

BRIEF DESCRIPTION OF THE FIGURES

FIGS. 5A–D are enlarged portions of the side view of FIG. 4A showing additional details and alternate arrangements of the legs and brackets;

FIGS. 8A–B are plan views of alternate forms of brackets used for coupling the supporting legs of the book holder.

DETAILED DESCRIPTION OF THE PREFERRED EMBODIMENT

Figure 1:
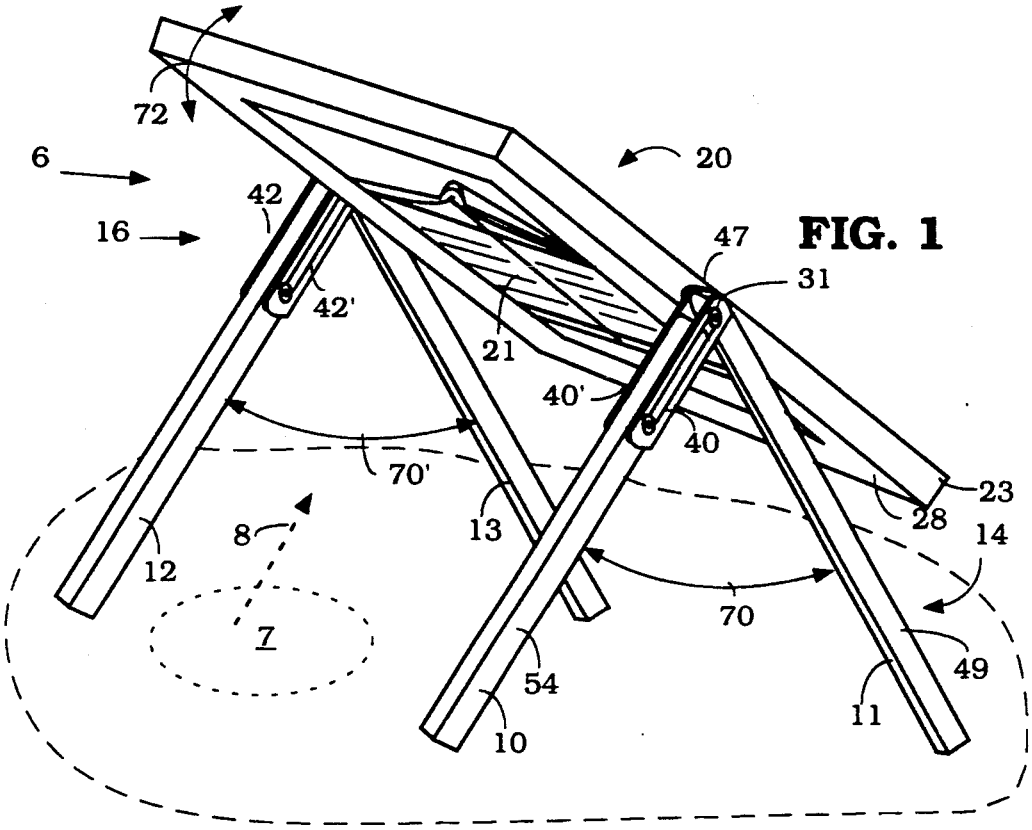
FIG. 1 is a simplified perspective view of the book holder of the present invention, according to a preferred embodiment.

Referring now to FIGS. 1–4, book holder 6 according to the present invention, comprises four legs 10–13 arranged in pairs 14, 16. That is, legs 10,11 comprise first pair 14 defining first substantially vertical plane 15, and legs 12,13 comprise second pair 16 defining second substantially vertical plane 17. Book holder 6 is adapted to be used by viewer having his or her head approximately in position 7 and whose view extends in the direction of arrow 8.

Leg pairs 14,15 and planes 15,17 are joined by book tray 20 containing book 21 and defining transverse plane 22. Book tray 20 may have any configuration capable of supporting book 21, but is conveniently in the shape of a rectangular frame 23 (see FIGS. 6 and 7A-C) whose center 24 is open, much like a picture frame. The periphery of frame 23 conveniently has "L" or "U" shaped cross section 25,25', but other cross-sections will also serve.

One or more adjustable rods 26 conveniently extend between sides 27,29 of frame 23 and on which book 21 rests. The lower edge of book 21 conveniently rests against bottom edge 28 of frame 23. When cross-section 25' of frame 23 is "U" shaped, bottom edge 28 conveniently has extended lip 28'.

Pivot means 31,32 conveniently extend from sides 27,29 and permit frame 23 to rotate about axis 33 formed by pivot means 31,32. Axis 33 is conveniently located distance 34 from bottom edge 28 of frame 23 (see FIG. 6). Distance 34 is desirably about half or less of the length of edges 27,29 of frame 23, conveniently about twenty-five to forty-five percent, and preferably about thirty to forty percent of the length of edges 27,29 of frame 23.

Pivot means 31,32 are conveniently rods or bolts of circular cross-section (see FIG. 6), although any other means for pivoting frame 23 around axis 33 may also be used. The outboard ends of rods 31,32 are conveniently threaded to accepted thumb screws or wing nuts 35 for temporarily fixing the angular orientation of frame 23 around axis 33 (e.g., compare FIGS. 4A for a supine reader and 4B for a seated reader).

Figure 6:
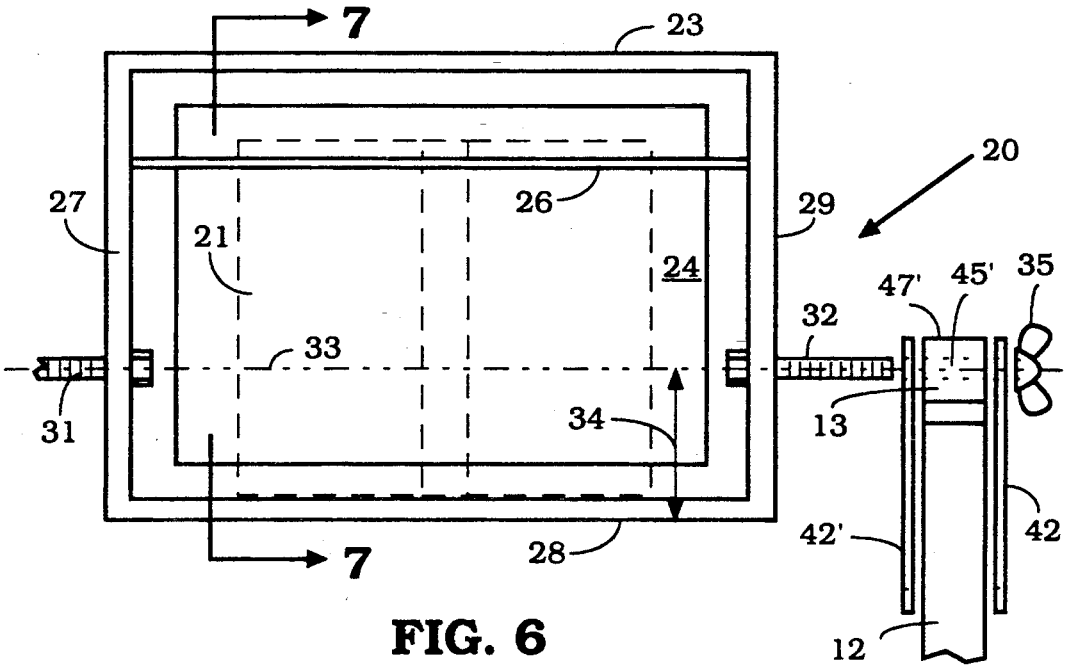
FIG. 6 is a rear view of a tray for holding a book and an exploded view showing how one of the supporting legs attaches thereto.
Figure 7A:
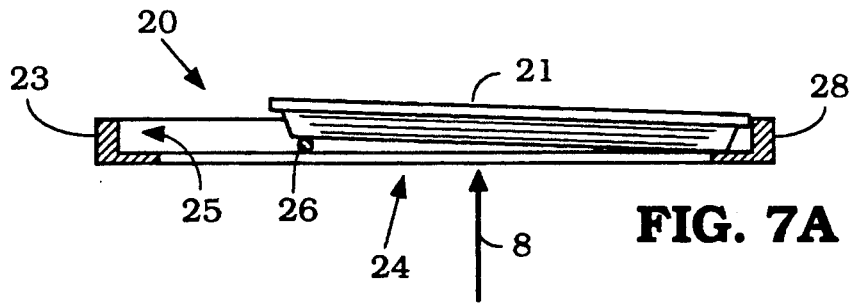
FIGS. 7A–C are simplified cross-sectional views through the tray of FIGS. 1, 4A–B and 6 according to different embodiments of the present invention.
Figure 7B:
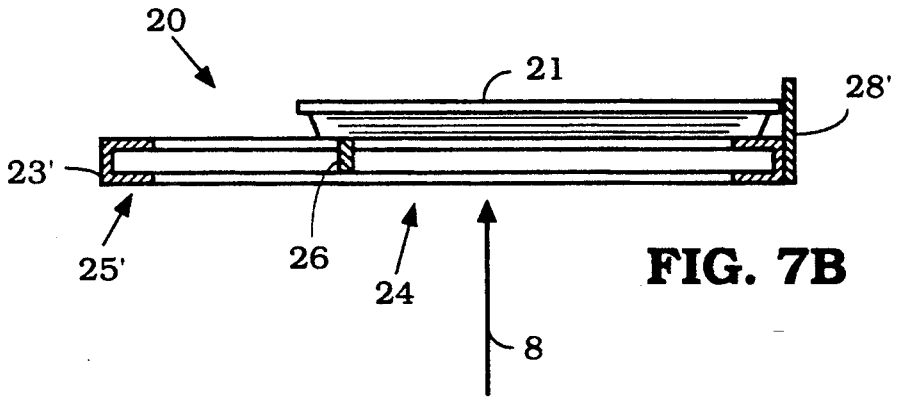
Figure 7C:
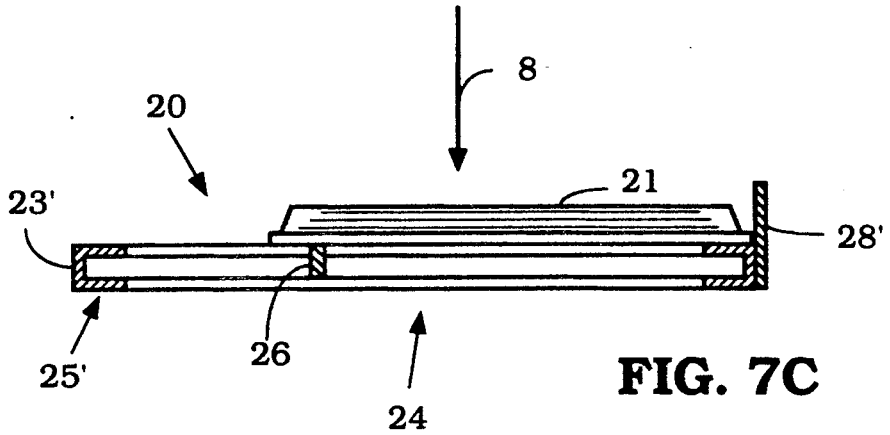

Legs 10,12 are coupled by slotted bracket 40 and legs 12,13 are coupled by slotted bracket 42. FIGS. 5A-D show side views illustrating various exemplary ways in which legs 10,11 and slotted bracket 40 may be arranged and FIG. 6 shows an exploded view of the portion of holder 10 around bracket 40, illustrating how bracket 42 and legs 12,13 are assembled to frame 23 of tray 20.

Referring now to FIGS. 4A-B, 5A-D, 6 and 8A-B, hole 45' passes through leg 13 near upper end 47', and similarly for leg 13 with hole 45 and upper end 47. Hole 45 extends between flat faces 49,49' of leg 11 and hole 45' between the analogous flat faces of leg 13. Slotted brackets 40,40 (See FIGS. 1 and 8A-B) desirably have mating hole 50 and elongated slot 51, although hole 50 may be omitted and extended elongated slot 51' may serve both functions. FIGS. 8A-B illustrate alternative versions 400 and 401 of slotted brackets 40,42. Brackets 40,40' and 42,42' (see FIG. 1) are conveniently the same.

Figure 2:
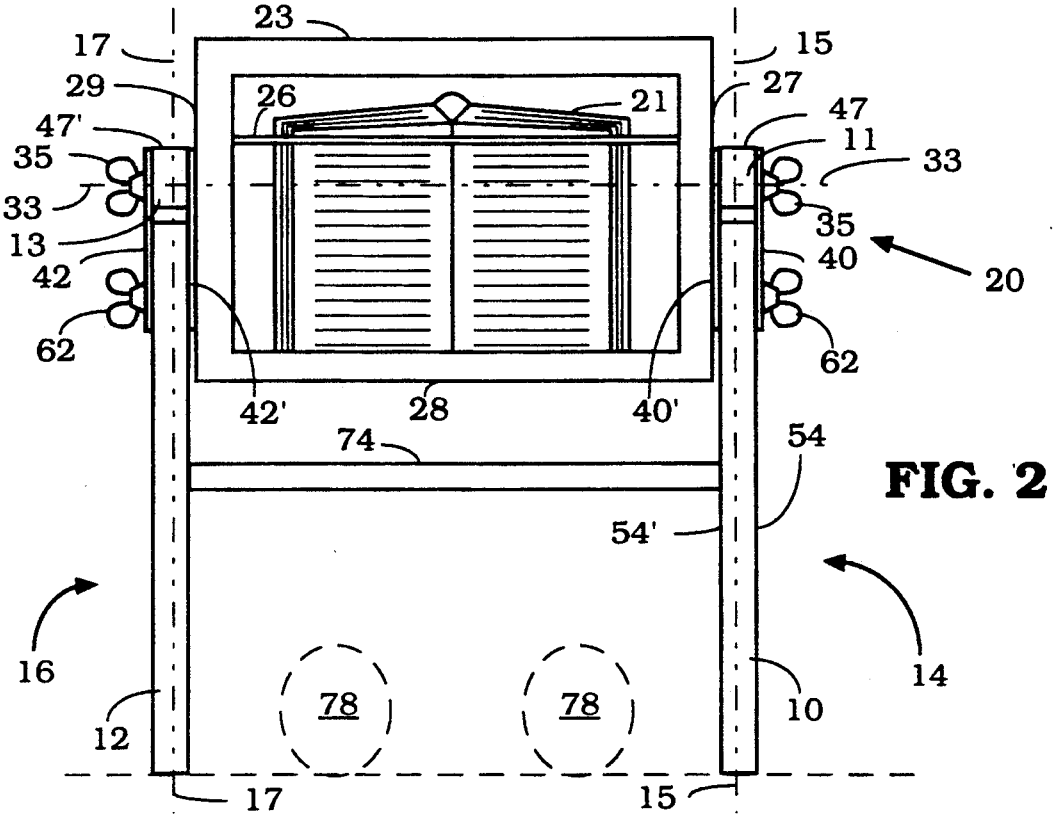
FIG. 2 is front view, i.e., as seen by a supine reader, of the holder of FIG. 1
Figure 3:
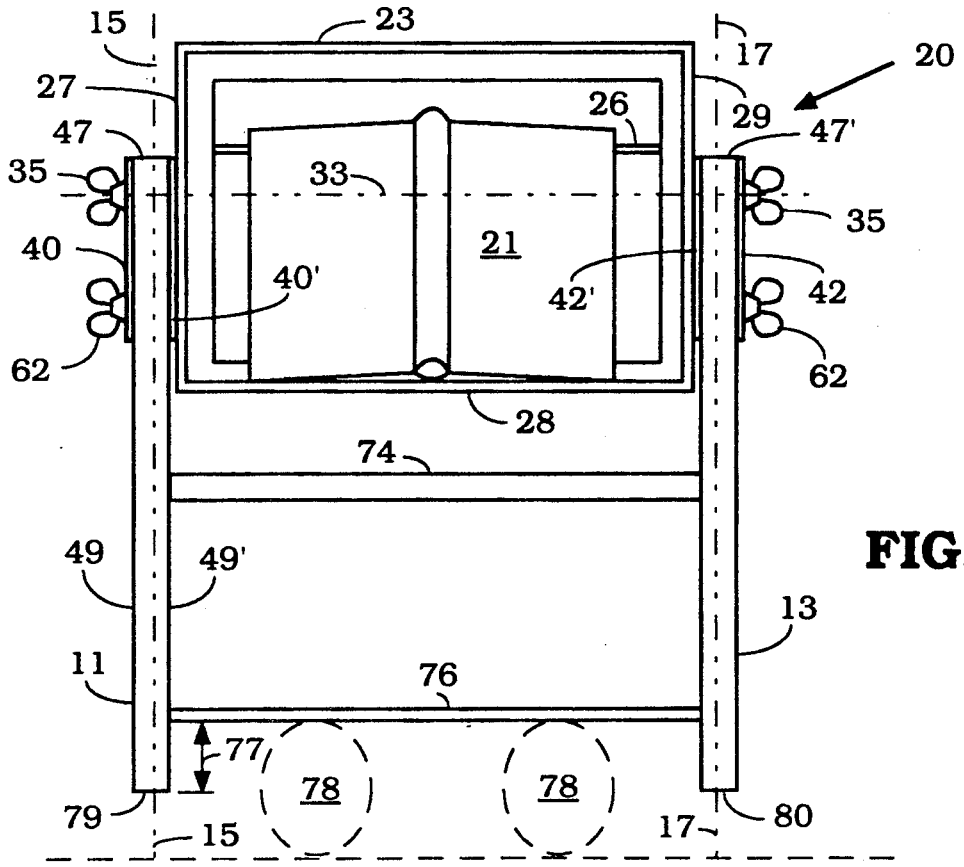
FIG. 3 is a rear view, i.e., as seen looking toward a supine reader.

Pivot means 31,32 extending from edges 27,29 of frame 23 pass through holes 45,50 and 45', 50 respectively and are fixed at the desired orientation by adjustable wing nuts or thumb screws 35. While holder 10 works well with only a single bracket per leg pair, e.g., bracket 40 for leg pair 14 and bracket 42 for leg pair 16, using two parallel brackets 40,40' and 42, 42' is better. The doubel bracket arrangement is seen in FIGS. 1-3. Slotted brackets 40,40 conveniently bear against faces 49,49' of leg 11 and faces 54,54' of leg 10, respectively. The arrangement with respect to legs 12,13 and brackets 42,42 is substantially identical.

FIGS. 5A-D illustrate in side view several different relative orientations of legs 10, 11 and bracket 40. The wing nuts or thumb screws 35,62 that hold the parts together have beem omitted so as not to obscure the view. In FIG. 5A, end 59 of leg 10 is substantially butted against leg 11 near end 47. Threaded bolt 60 (and thumb screw 62, not shown here) are conveniently used to tighten bracket 40 (and 40') against faces 49, 49' and 54,54' of legs 11 and 10 respectively. Bolt 60 is substantially at the upper end of slot 51.

In FIG. 5B, end 59 of leg 10 has been moved downwardly with respect to end 47 of leg 11 so that bolt 60 is at or near the distal end of slot 51. In FIG. 5C, bolt 60 again passes through the distal end of slot 51, but slotted bracket 40 has been rotated away from the axis of leg 11 so that legs 10,11 are not in contact, and in FIG. 5D bracket 40 has been rotated further so that end 47 of leg 11 rests again the side of leg 10, i.e., the topological complement to the position of FIG. 5B.

In general, the use of bracket 40 permits the pivots passing through the upper end regions of legs 10,11 (and 12,13) to be located anywhere within a large segment of a circlle of perimeter 68 lying between the extreme positions of FIGS. 5B and 5D. Circle 68 has a radius equal to the distance from hole 50 to the end of slot 51 (as in FIG. 8A), or alternatively the distance between the ends of slot 51' (as in FIG. 8B).

It will be apparent from FIGS. 5A-D, that the use of brackets 40,42 to join legs 10,11 and 12,13 provides for articulation of the legs making up each leg pair 14,16 so that the relative position and orientation of the ends may be easily varied. In addition, and substantially independent of the variations obtained by rotation of brackets 40,42, angle 70 between legs 10,11 (and the corresponding angle 70' between legs 12,13) may also be varied by adjustment of the spreading of leg pairs 14,16. Since axis 33 of book tray 23 is supported by passing through the end regions of one leg of each pair, this provides a capability for substantial adjustment of the position of book tray 20 relative to the viewer, i.e., up-down and toward-away. These adjustments are in addition to that which is obtained by increasing or decreasing angles 70,70' of the leg pairs by moving the lower ends of the legs of each pair closer together or further apart. Having the additional degrees of adjustment freedom provided by the articulated upper leg end arrangement of the present invention is a substantial help in circumstances where other factors (i.e., the nature of the bed or seat on which the viewer is resting) make it difficult or impossible to freely adjust the spacing of the lower ends of the leg pairs.

Figure 4A:
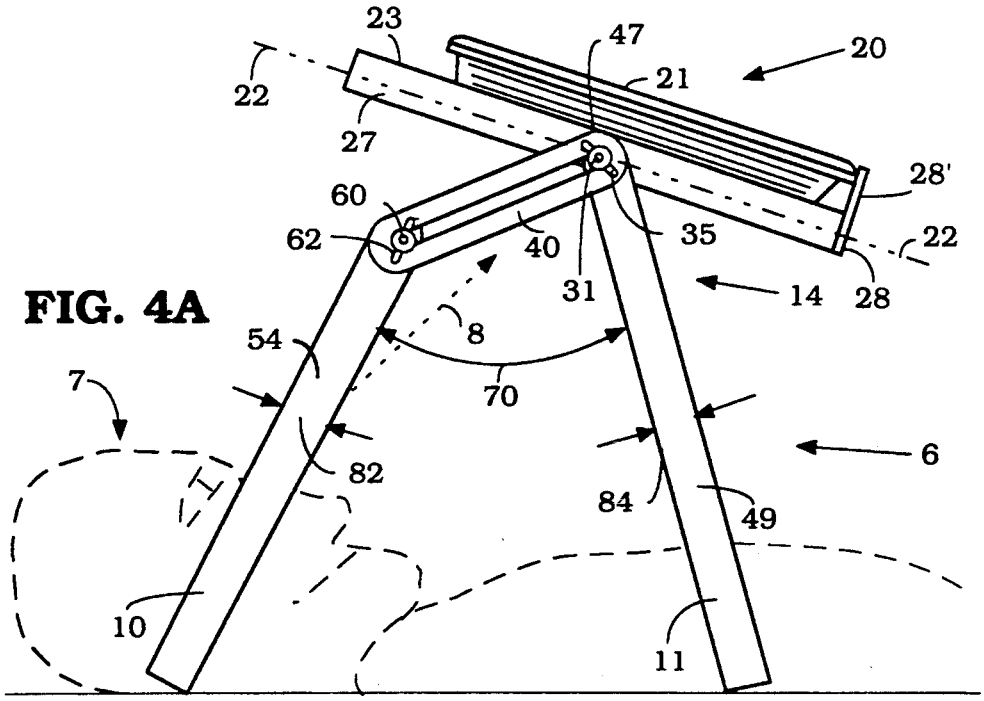
FIG. 4A is a first side view of the holder of FIG. 1 being used by a supine reader and FIG. 4B is a second, opposite, side view of the holder of FIG. 1 being used by a seated reader.
Figure 4B:
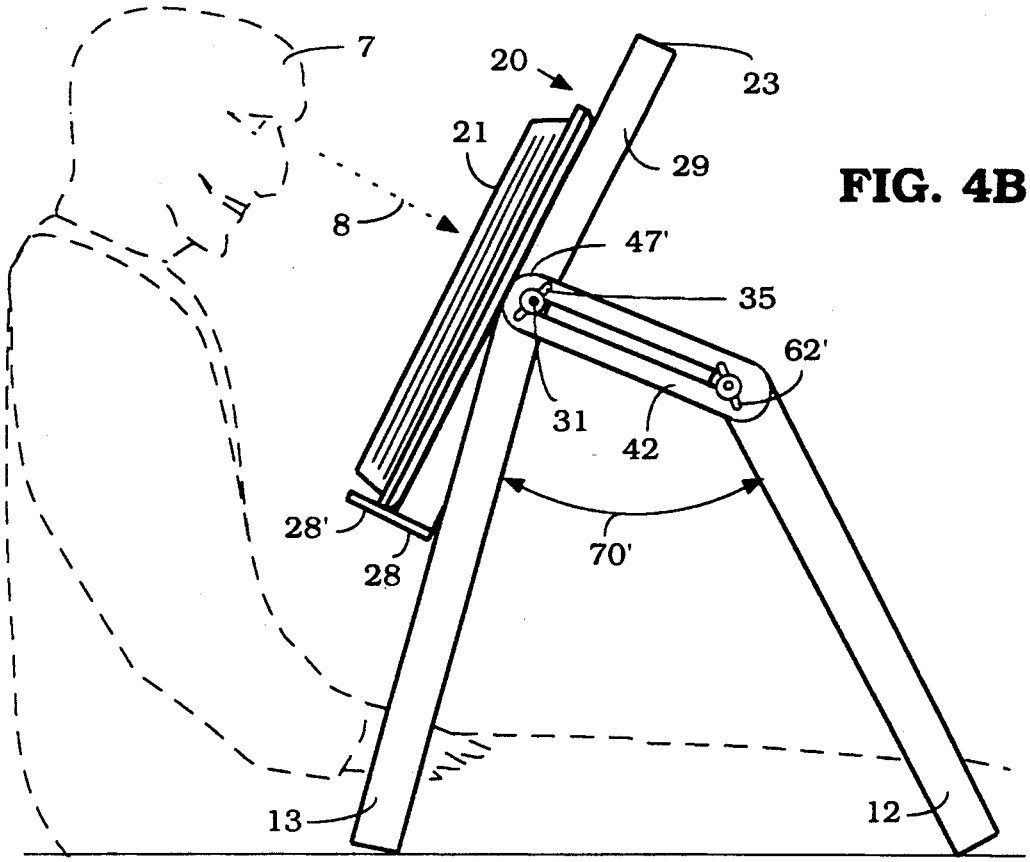

In addition, since frame 23 pivots on axis 33 this allows book tray 20 to be rotated as shown by arrows 72 independent of the other adjustments, so that the desired viewing angle may be obtained. This is illustrated in FIGS. 4A-B. In FIG. 4A, book tray 20 is rotated such that book 21 rests face-down with open pages toward tray 20. In FIG. 4B, book trays 20 is rotated so that book 21 rests face-up with open pages facing away from tray 20. In each instance, the open pages of book 21 face toward reader 7, the tray being adjusted in FIG. 4A to suite a supine reader and in FIG. 4B to suit a seated reader.

In order to impart additional stability to book holder 6, it is desirable to provide fixed brace 74 extending between the leg pairs, as for example, between legs 11 and 13 (e.g., see FIGS. 2-3). Further, while the invented arrangement has been illustrated for the situation where pivoting means 31,31 passes through holes in or near the ends of legs 11,13, they can just as well pass through the holes in legs 10,12 occupied by bolts 60 so that slotted brackets 40,42 rotate around the centerlines of bolts 60 near the ends of legs 10,12 rather than around the centerlines of bolts 31,32 near the ends of legs 11,13.

A further feature of the present invention is provided by adjustable brace 76. Brace 76 has adjustable spacing 77 from the lower ends of the legs to which it is attached, e.g., legs 11,13. Spacing 77 is chosen so that when holder 6 is placed across thigs 78 of a seated reader, brace 76 supports the weight of frame 20 carried by legs 11,13 (see FIG. 3). With this arrangement, it is not necessary for lower ends 79,80 of legs 11,13 to touch any support. This is a great convenience since it permits the height of pivot line 33 of book tray 20 to be convenient to the viewer even under circumstances where the seat on which the viewer rests is so short (along the thighs) as to provide no place to support ends 79,80 with an acceptable inter-leg angle 70,70'. With brace 76 removed (or mounted further away from ends 79,80), then ends 79,80 of legs 11,13 rest on the external support underneath thighs 78 if such is present (e.g., see FIG. 2). Several holes of a size to accommodate brace 76 are conveniently drilled in legs 11,13 at different distances 77 from the ends of legs 11,13 so as to allow for easy adjustment of brace 76, as described above, but any other means for providing a variable distance 77 will also serve.

Holder 6 is conveniently constructed out of a combination of wood, plastic and /or metal although other materials may also be used. Legs 10–13 are conveniently formed of wood or plastic. Brackets 40,42 are conveniently of metal, e.g., brass, aluminum or steel. Book tray 20 may be made from any convenient material. Wood, metal, and plastic are suitable. Bolts, screws and/or pivots are conveniently from metal. The dimensions of the individual pieces are chosen so as to support the size book desired when the book holder is straddling the body of the size person who intends to use the holder. Thus, a winde range of different dimensions are suitable depending upon the needs of the user.

As an example, and not intended to be limiting, legs 10, 12 are conveniently about twenty inches long and about three-quarters of an inch square inches in cross-section, legs 11, 13 are conveniently about twenty-three inches long and about the same cross-section. Book tray 20 is conveniently about eleven inches high and about seventeen inches wide, with the long dimension extending between leg pairs 14, 16. A "U" shaped aluminum channel about 5/16th inches on a side in cross-section is convenient for tray 23. Lip 28' is conveniently about 1.5 inches high so as to form a convenient stop to prevent book 21 from sliding off tray 20 (e.g., see (FIGS. 4A–B).

Slotted brackets 40, 42 are conveniently about 7.5 inches long by 0.75 inches wide and about 1/16th to ⅛th inch thick, and have slots therein about ¼th inch wide. Brace 74 is typically about ¾th inch square in cross-section and about 17.5 inches long. Support brace 76 is typically about ¼th inch in diameter.

Having thus described the present invention, it will be apparent to those of skill in the art that the invented arrangement provides a particularly convenient, simple, easy to use book holder having great flexibility of adjustment. It will be further apparent that by loosening pivot means 31, 32 and bolts 60, 60', that the entire assembly folds to a thickness equal to the sum of widths 82, 84 of the legs. This makes storage of the holder very convenient.

An additional advantage of the present arrangement, unlike those prior art designs employing telescoping legs or other adjustments at the side, is that the orientation and position of the book may be adjusted after the holder has been placed over or in front of the reader by adjustments that are made above or in front of the viewers body. The thumb screws that loosen and adjust the brackets or tilt the book tray are above or in front and not at the side of the reader. Thus, the reader does not need to bend his or her arms into such a position so as to make adjustments at the side of the body, something which many arthritic persons find difficult to do.

The importance of this front-adjustment feature may be appreciated by comapring the relative ease with which one can push the horn button of a car or adjust a column mounted shift lever as compared to putting the buckle into the seat belt retainer or adjusting the seat tilt lever. This is because the horn button and shift lever are in front of a seated person's body while the seat belt buckle and the seat adjustment level are at the side, typically near the right or left hip. The same problem occurs in prior art book holders which have adjustments at the ends or near the lower parts of the legs and located at the side of the reader's body. The invented arrangement avoids this and other problems and provides features not realized in the prior art, in aparticularly simple way.

While the invented arrangement has been described for particular types of legs and book tray, e.g., rectangular, those of skill in the art will understand based on the description herein that the cross-sectional shape and materials of construction may be varied without departing from the scope of the present invention.

What is claimed is:

1. A book support comprising:

a tray for supporting the book and having a left side and a right side;

first thorugh fourth legs of predetermined lengths;

first slotted bracket pairs extending between and adjustably coupled approximately to ends of the first and second legs for allowing spacing of the ends to be varied and an angle between the first and second legs to be varied;

second slotted bracket pairs extending between and adjustably coupled approximately to ends of the third and fourth legs for allowing spacing of the ends to be varied and and angle between the third and fourth legs to be varied;

first attachment means rotatably coupling one of the first and second legs and one end of the first slotted bracket pairs to the left side of the tray; and second attachment means rotatably coupling one of the third and frouth legs and one end of the second slotted bracket pairs to the right side of the tray.

2. The bood support of claim 1 furtherr comprising a fixed brace coupling two of the first through fourth legs.

3. The book support of claim 1 further compising a relocatable load bearing member for vertical loads, substantially horizontally coupling the first and third legs or second and fourth legs located nearer to but spaced from ends of the legs distal to the attachement means for transferring the weight of the book support to the thighs of a seated reader.

4. The book support of claim 1 wherein the tray is pivotally attached to the legs other than at the center of the edges of the tray.

5. The book support means of claim 4 further comprising clamping means for temporarily fixing the angle of the tray with respect to the legs.

6. The book support means of claim 1 further comprising clamping means for clamping the slotted brakets to the legs.

7. The book support means of claim 1 wherein the slotted brackets have holes therethrough wherein passes an attachement means to one leg and a slot therethrough wherein passses an attachment means to another leg, said attachment means being adapted to clamp the brackets against the legs or allow the bracket to move with respect to the legs.

8. A holder for material being viewed or read, comprising:

a first pair of legs defining a first vertical plane and a second pair of legs defining a second vertical plane, said legs having free standing, uncoupled, lower ends;

first slotted bracket means extending between substantially upper ends of the first pair of legs and second slotted bracket means extending between substantially upper ends of the second pair of legs, for adjustably fixing the upper ends in predetermined relationship as to spacing and orientation, and for determining an angle between the legs of each pair; and a shallow substantially rectagular support frame for reading material, transverse to the vertical planes and extending therebetween and adapted to rotate about a line extending between the vertical planes, coupled to and holding the leg pairs together and upright for supporting the reading material at an angle selected by the user.

9. The holder of claim 8 wherein the substantially rectangular support frame has attachment points along opposed sides totatably couupled to one leg of each pair.

10. The holder of claim 8 wherein one leg from each pair has a support coupled therebetween located near but spaced from the lower ends thereof for bearing the weight of the holder when used by a seated reader without the lower ends thereof resting on a support.

11. The holder of claim 10 further comprising a fixed transverse brace coupling one leg from each pair, said brace being located between the upper ends of the legs and the support.

12. The holder of claim 8 wherein the first and second slotted bracket means comprise a pair of opposed slotted brackets per pair of legs, each bracket of the slotted bracket pair eing placed in oppoistion to the other against opposed flat faces of the legs and parallel to the vertical planes.

* * * * *